US012123140B2

(12) United States Patent
Mai et al.

(10) Patent No.: US 12,123,140 B2
(45) Date of Patent: Oct. 22, 2024

(54) PROCESS TO PRODUCE MICROFIBRILLATED CELLULOSE BY IMPACTS

(71) Applicant: Suzano S.A., Salvador (BR)

(72) Inventors: Estevão Frigini Mai, Vila Velha (BR); Matheus Antunes Guimarães, Aracruz (BR); Bibiana Ribeiro Rubini, São José dos Campos (BR)

(73) Assignee: Suzano S.A., Salvador (BR)

( * ) Notice: Subject to any disclaimer, the term of this patent is extended or adjusted under 35 U.S.C. 154(b) by 545 days.

(21) Appl. No.: 16/988,458

(22) Filed: Aug. 7, 2020

(65) Prior Publication Data

US 2021/0348332 A1 Nov. 11, 2021

Related U.S. Application Data

(60) Provisional application No. 63/023,075, filed on May 11, 2020.

(51) Int. Cl.

| | |
|---|---|
| ***D21D 1/22*** | (2006.01) |
| ***D21D 1/30*** | (2006.01) |
| ***D21H 11/18*** | (2006.01) |

(52) U.S. Cl.

CPC ..... *D21D 1/22* (2013.01); *D21D 1/306* (2013.01); *D21H 11/18* (2013.01)

(58) Field of Classification Search

CPC ..... D21D 1/22

USPC ..... 162/26

See application file for complete search history.

(56) References Cited

U.S. PATENT DOCUMENTS

| | | | | |
|---|---|---|---|---|
| 2014/0284407 | A1 | 9/2014 | Tamper et al. | |
| 2015/0299955 | A1 | 10/2015 | Laukkanen et al. | |
| 2016/0102433 | A1* | 4/2016 | Nuopponen ..... | D21D 1/004 162/28 |
| 2017/0107666 | A1 | 4/2017 | Kajanto et al. | |
| 2017/0211230 | A1 | 7/2017 | Nuopponen et al. | |

FOREIGN PATENT DOCUMENTS

| | | | |
|---|---|---|---|
| WO | 2014045209 | A1 | 3/2014 |
| WO | 2019048616 | A1 | 3/2019 |

OTHER PUBLICATIONS

International Search Report for PCT/BR2021/050196, mailed Aug. 18, 2021 (5 pages).

* cited by examiner

*Primary Examiner* — Jacob T Minskey

(57) ABSTRACT

The present invention relates a process to produce microfibrillated cellulose and a microfibrillated cellulose produced according to such process. The fibrillated microfibrillated cellulose is obtained subjecting a cellulose fiber in a slurry of cellulose pulp to multiple mechanical impacts. The cycle may be repeated several times. Non-cutting bars disposed in a ring formation is the preferred method. Two rings concentrically arranged facing each other in high rotation transmit the kinetic energy to the fibers to provide the highly defibrillated microfibrillated cellulose.

18 Claims, 9 Drawing Sheets

PROCESS TO PRODUCE MICROFIBRILLATED CELLULOSE BY IMPACTS

FIELD OF INVENTION

The present invention relates a process to produce microfibrillated cellulose and a microfibrillated cellulose produced according to such process. The microfibrillated cellulose is obtained subjecting a cellulose fiber in a slurry of cellulose pulp to multiple mechanical impacts. The cycle may be repeated several times. Non-cutting bars disposed in a ring formation is the preferred method. Two rings concentrically arranged facing each other in high rotation transmit the kinetic energy to the fibers to provide the highly defibrillated microfibrillated cellulose.

BACKGROUND

Cellulose is one of the most abundant organic polymers in nature. It is generally synthesized by plants, but it is also produced by some bacteria. Cellulose it is a polysaccharide consisting of a linear chain of several hundred to many thousands of β (1→4) linked d-glucose units. Cell walls of the plants attribute their mechanical strength to cellulose. Cellulose owes its structural properties to the fact that it can retain a semi-crystalline state of aggregation even in an aqueous environment, which is unusual for a polysaccharide. In plant cell, it aggregates regularly along the chain, resulting in inter and intra-molecular hydrogen bonds and hydrophobic interactions, and forms fibrous structures called micro fibrils that, in turn, are composed of elementary fibrils or nanofibrils, which are the basic structural units.

Several sources of cellulose have been used to obtain cellulose micro/nanofibers including hardwood, softwood, soybean, cotton, wheat straw, bacterial cellulose, sisal, hemp, sugar bagasse and others. Nanofibrillated cellulose is currently manufactured from a number of different cellulosic sources. Wood is the most important industrial source of cellulosic fibers. Obtaining micro fibrillated cellulose from wood is a challenge. Typically, it requires great amount of energy to overcome the extensive and strong inter-fibrillar hydrogen bonds while preserving intramolecular bonds. In other words, the fibrils are processed in such way that micro/nanoscale diameters are achieved but maintaining the long axial lengths to attain high aspect ratio. Among the various extraction processes proposed so far, most are mechanical. For instance, homogenizer, microfluidizer, super-grinder, grinding, refining, cryocrushing, etc. are mechanical methods.

Besides the simple mechanical means to disintegrate cellulose fibers into MFC, associations with chemical and enzymatic pretreatments can be used. The usage of different enzymes (cellulases, oxygenases, xylanase, etc.) or chemical modifications (TEMPO—oxidation, carboxymethylation, etc.) may be used as pretreatment in order to reduce the energetic cost on the MFC production.

Specifically, in the case of MFC production via simple mechanical means, to the cellulosic pulp is applied high intensity shear forces that lead to the individualization of the fibrils. Amongst those mechanical processes, the homogenization is performed under extremely high pressure and is characterized by the great amount of energy required to fibrillate the fibers. In a homogenization process, a cellulose slurry is passed through a very tiny gap between the homogenizing valve and an impact ring, subjecting the fibers to shear and impact forces, which results in cellulose fibrillation. As an alternative for homogenization, the micro fluidization can be used to obtain micro/nanofibrils typically characterized by diameters ranging from 20 to 100 nm and several tens of micrometers in length. The micro fluidization consists in passing the cellulose suspension through a thin chamber with a specific geometry, e.g., a Z- or Y-shape, with an orifice width of 100-400 μm under high pressure, where strong shear forces and impact of the suspension against the channel walls are produced, resulting in cellulose fibrillation. Although producing a high quality MFC/NFC, both processes faces important challenges in order to become economically feasible: great amount of energy to produce, operational issues such as clogging and industrial scalability.

Also, ultra-fine friction grinding is another technique used for the production of MFC/NFC. Supermasscolloider grinder from Masuko Sangyo Co. Ltd., Japan, is one example commonly used. The production of MFC/CNF may be obtained by passing natural fiber suspensions "n" times through the grinder stones. The shear forces generated from the grinder discs are applied to the fibers leading to cell wall delamination and, consequent individualization of the micro/nanofibrils. MFC/NFC are usually obtained with a diameter in the range of 20-90 nm. Alternatively, disc or conical refiners may also be used to produce MFC/NFC throughout a process that includes both mechanical and hydraulic forces to change the fiber characteristics. Typically, pulp is pumped into the refiners and forced to pass between rotating bars located on a stator and a rotor. Therefore, different types of stress forces are applied to the fiber (crushing, bending, pulling and pushing) between the refining bars of the fillings. Shear stresses like rolling and twisting occur in the grooves. Other mechanical processes can be used such as Ultrasonication, Cryocrushing, Ball milling, Extrusion, Aqueous counter and Steam explosion.

The present process also provides a microfibrillated cellulose without the use of enzymatic or chemical treatments, being environment friendly and avoiding costly or harmful operations, readily applicable to high throughput demands and elevated production. The present process also provides a process to process cellulose fibers and to further process MFC or NFC fibers.

BRIEF DESCRIPTION OF THE INVENTION

The present invention is a process to produce microfibrillated cellulose and a microfibrillated cellulose produced according to such process. The highly fibrillated microfibrillated cellulose is obtained by subjecting a cellulose fiber in a slurry of cellulose pulp to multiple mechanical impacts. The cycle may be repeated several times. Non-cutting bars disposed in a ring formation of projections is the preferred configuration. Two rings concentrically arranged facing each other having several bars as projections in high rotation transmit the kinetic energy to the fibers producing the highly defibrillated microfibrillated cellulose. The cellulose fibers may be Kraft fibers, bleached cellulose fibers, semi-bleached cellulose fibers, unbleached cellulose fibers; dry cellulose fibers, never dry cellulose fibers, microfibrillated cellulose fibers (MFC), nanofibrillated cellulose fibers (NFC) or mixtures thereof.

A first embodiment of the present invention is a process to produce microfibrillated cellulose, which process comprises the steps of:

a) providing a slurry comprising cellulose fibers, b) subjecting the slurry to defibrillation under continuous impacts to produce microfibrillated cellulose.

The microfibrillated cellulose may be returned as a slurry to step a) to another defibrillation step. Preferably, the impacts are provided by non-cutting bars, more preferably the non-cutting bars are in a rotor, in a stator or in both, which at least one is rotating. Also, it is provided a microfibrillated cellulose produced according to the process.

DETAILED DESCRIPTION OF THE INVENTION

The process of the present invention comprises providing impacts in the cellulose fibers to produce highly fibrillated microfibrillated cellulose fibers. The impacts may be provided by any means and are preferably provided by non-cutting bars.

An embodiment of the present invention is a process to produce a highly microfibrillated cellulose, which process comprises the steps of:

a) providing a slurry comprising cellulose fibers, b) subjecting the slurry to defibrillation under continuous impacts to produce microfibrillated cellulose.

Figure 1:
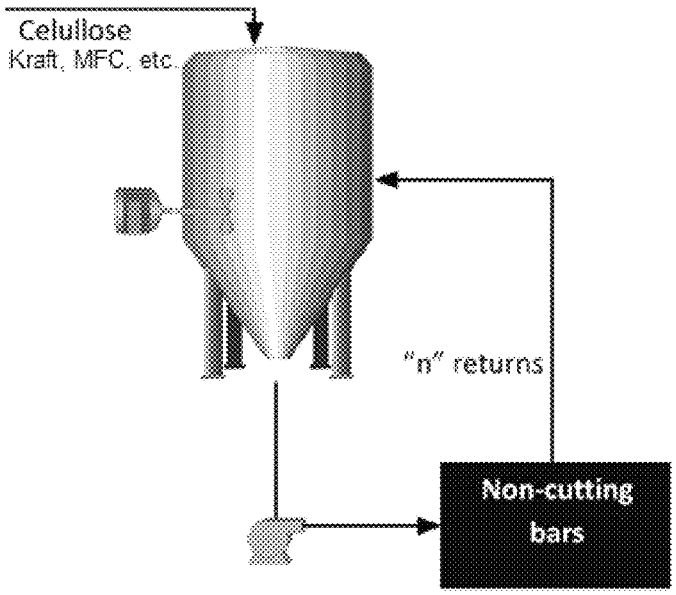
FIG. 1 is a schematic representation of the present process.

FIG. 1 is a schematic view of the present process having the non-cutting bars disposed in concentrically circles forming rings in a rotor and a stator.

Each of the non-cutting bar ring have an axis defined at its center. The rings are provided with rotating means and rotate. In one embodiment, the rotor ring rotates, and the stator ring is static. In another embodiment, the rotor ring is static, and the stator ring rotates. In a further embodiment, the rotor ring and the stator ring rotate in contrary directions.

The non-cutting bars may be projections in the rotor, the stator or in both. Two non-cutting bars form a bar gap between, and the non-cutting bars alternate with projection gaps in the ring formed at the rotor, the stator or in both. The gap between two non-cutting bars in the same ring is at least 1 mm.

When the rotor and the stator with concentrically bar rings are matched facing each other, a ring gap of at least 200 μm is formed between the rings. Applying rotation to the rotor, the stator or both transmits kinetic energy to the bars that impact the fibers disposed through the bar gaps of the rings.

Preferably, the impacts to the cellulose fibers are provided by non-cutting bars disposed in a rotor or stator, preferably projecting from the rotor or stator, preferably from projecting both.

The non-cutting bars projecting are disposed in, or projected from, the rotor, the stator, or both, in a ring configuration, forming a circle or ring in the surface of the rotor, stator, or both. In a ring configuration, the rotor, the stator, or both, when rotating, also rotates the ring formed with the bars, providing a linear speed to the ring. Preferably, the bars are at a linear speed from 20 to 200 m/s, preferably 70 m/s. In one embodiment, the rotor ring rotates at a linear speed of at least 20 m/s, preferably 70 m/s, and the stator ring is static. In another embodiment, the rotor ring is static, and the stator ring rotates at a linear speed from 20 to 200 m/s m/s, preferably 70 m/s. In a further embodiment, the rotor ring and the stator ring rotate in contrary directions, each at a linear speed from 20 to 200 m/s m/s, preferably 70 m/s.

As shown in FIG. 1, slurry having the fiber, in the form of a cellulose pulp, is fed to the process tank. The slurry consistency may be adjusted to values from 2.0 to 6%, preferably 3.5% to 5%, even more preferably of 4%.

The process of the present invention may also comprise at least one pH modifier added to the slurry during the treatment of the slurry, if modified microfibrillated cellulose is desired. In this case, the slurry is treated before the fibrillation process. The pH of the slurry may be corrected to values from 4.0 to 9.0, preferably, 8.0. If the pH should be corrected to a more basic pH, pH modifiers as ammonia, hydroxides as sodium hydroxide and, as potassium hydroxide and others as sodium hypochlorite. If the pH should be corrected to a more acidic pH an acid selected from acetic acid, phosphoric acid, nitric acid, hydrochloric acid and sulfuric acid may be used.

Once the parameters are adjusted, the slurry having the cellulose fibers is subjected to successive cycles throughout the equipment where the fibrillation occurs. The concentric non-cutting bars at the rotor and the non-cutting bars at the stator are disposed to produce a ring gap of at least 0.2 mm between the bars at the rotor and the bars at the rotor, stator, or both are subjected to a high linear speed from 20 to 200 m/s, preferably 70 m/s. The present invention provides that the rotor, stator or both rotor and stator may be rotating or only one of the rotor, the stator may be rotating.

Figure 2:
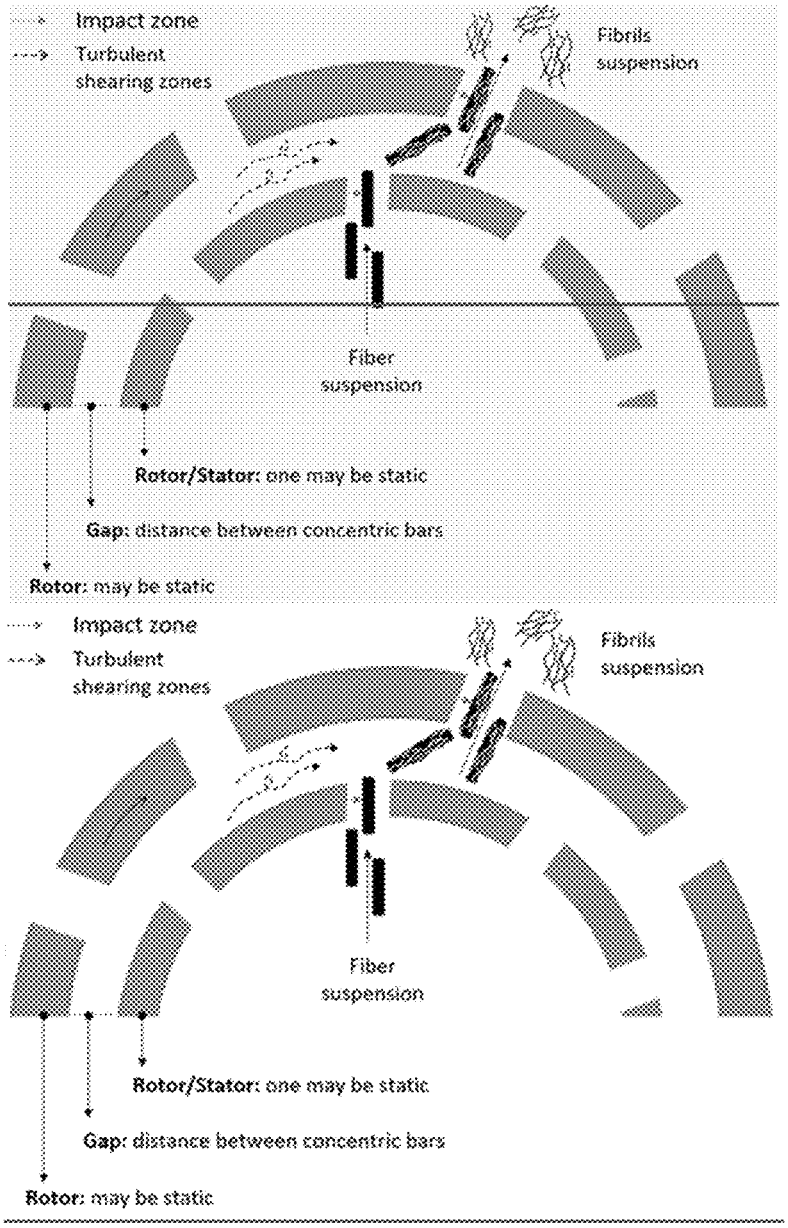
FIG. 2 is a drawing representing impact zones and turbulent zones between rotor and stator, according to one embodiment of the present invention.

FIG. 2 depicts the non-cutting bars of the rotor and the non-cutting bars of the stator disposition, forming a ring or circle, and the ring gap formed between. The fiber suspension slurry is discharged preferably in the inner zone of the concentrically rings and moves outwardly to the edges due to the rotation of the rotor, the stator, or both. The slurry moves from the inner zone of the stator non-cutting bars ring, reaching the non-cutting bars of the stator, where the fibers in the slurry are subjected to an event of impacts. After receiving the impacts of the stator non-cutting bars, the fibers in the slurry move to a turbulent shearing zone formed between the non-cutting bars of the rotor and the non-cutting bars of the stator. In a continuous outward movement, the fibers reach the non-cutting bars of the rotor, where the fibers are subjected to another event of impacts, producing microfibrillated cellulose.

Without being bound by theory, it is believed that the impacts on the fibers, together with the shear turbulence created in the ring gap between the rotor and stator rings with non-cutting bars produce the high degree of cellulose fibrillation. In this sense, the slurry is kept in the impact loop (cycle) from 5 to 240 minutes, preferably 60 minutes. Due to the heat generation during processing, the suspension may have the temperature controlled between 50 and 70° C.

The impact event defibrillates the fibers and continuously produce microfibrils. The microfibrillated cellulose produced may be returned to step a) as a slurry to another defibrillation step b). The process of the present invention may have as many cycles as necessary to produce a microfibrillated cellulose having a diameter in from 0.01 μm to 0.8 μm. Preferably, the microfibrillated cellulose have an average diameter of 0.1 μm, determined by scanning electron microscopy. When at 0.85% wt. in water the microfibrillated cellulose produced according to the process of the present invention has a dynamic viscosity from 15-1000 mPas·s measured on a rotational rheometer using vane geometry.

The use of impacts for producing microfibrillated cellulose and the use of non-cutting bars for producing microfibrillated cellulose via successive impacts produces a highly fibrillated cellulose having a high aspect ratio.

In one embodiment, the present invention is achieved by a process to produce a highly microfibrillated cellulose, which process comprises the steps of providing a slurry comprising cellulose fibers such as microfibrillated cellulose fibers (MFC). The process of the present invention will produce microfibrillated cellulose fibers will produce highly microfibrillated cellulose by subjecting the slurry of MFC to defibrillation under continuous impacts. The fibers may also be nanofibrillated cellulose fibers (NFC). In such embodiment, the nanofibrillated cellulose fibers will produce highly nanofibrillated cellulose by subjecting the slurry of NFC to defibrillation under continuous impacts. Accordingly, the slurry may comprise a mixture of MFC and NFC.

The slurry of MFC or NFC, or their combinations, may be previously obtained by processing the cellulose fibers with disc refiners, conical refiners, or combinations thereof. In this sense, processing the fibers is prevalently refining the fiber in order to decrease its diameter, previously to subjecting the MFC or NFC to the process to produce a highly microfibrillated cellulose, object of the present invention.

Figure 3:
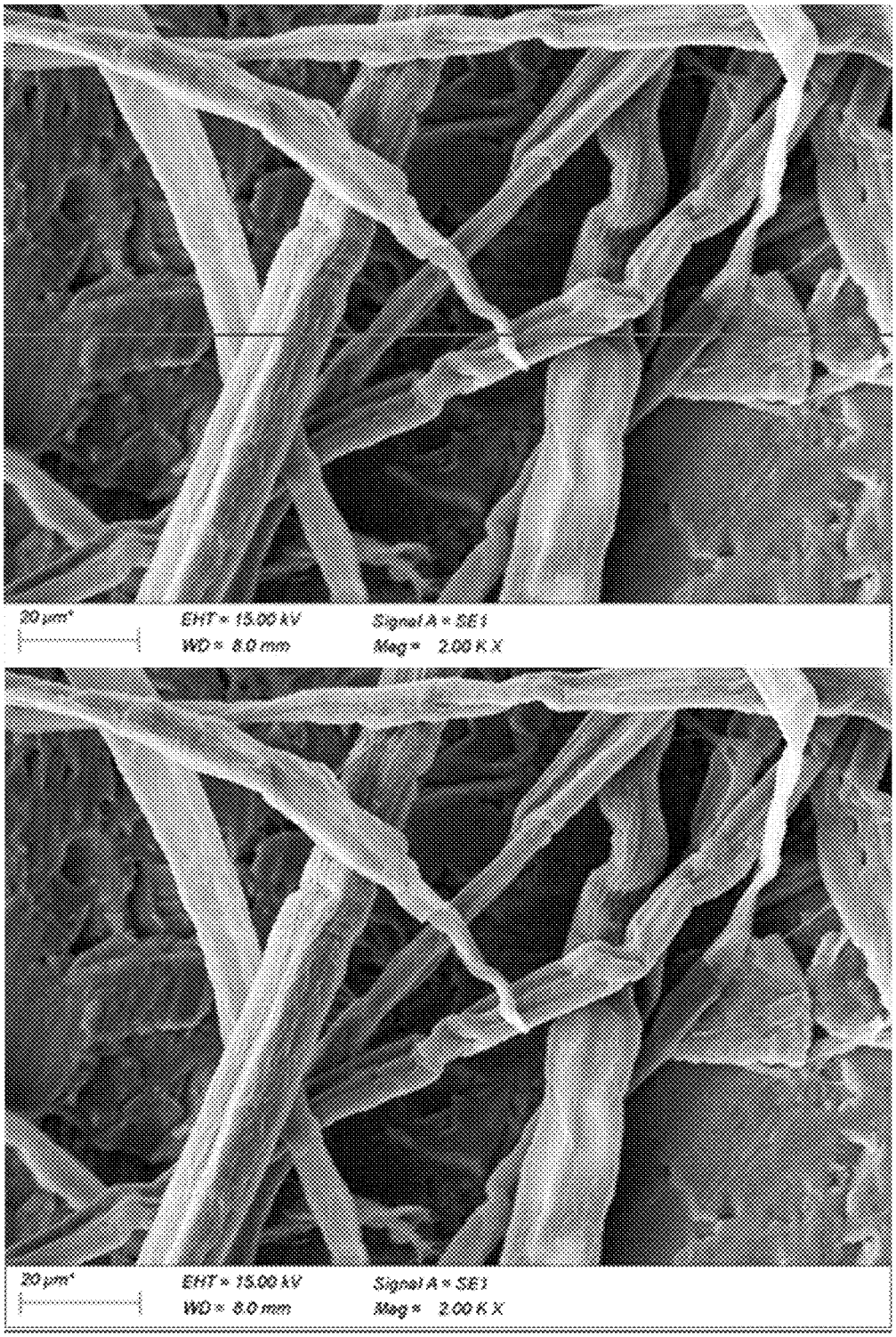
FIG. 3 is a scanning electron microscopy micrograph of a Eucalyptus Kraft cellulose fiber.
Figure 4:
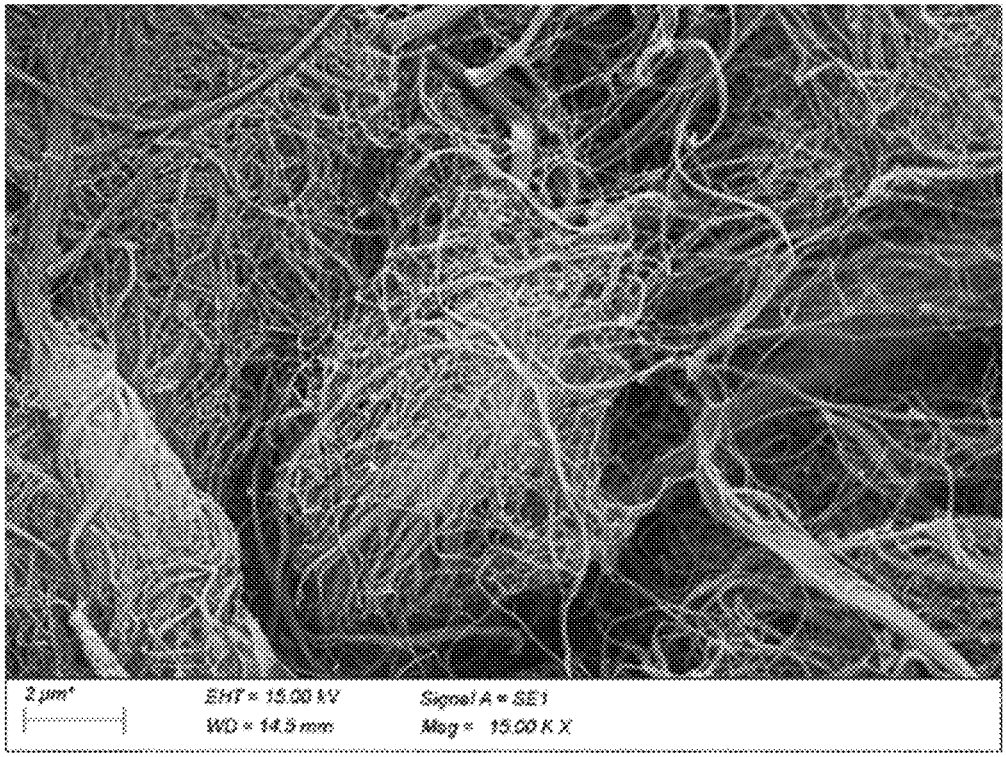
FIG. 4 is a scanning electron microscopy micrograph of a microfibrillated cellulose produced by the process of the present invention.
Figure 5:
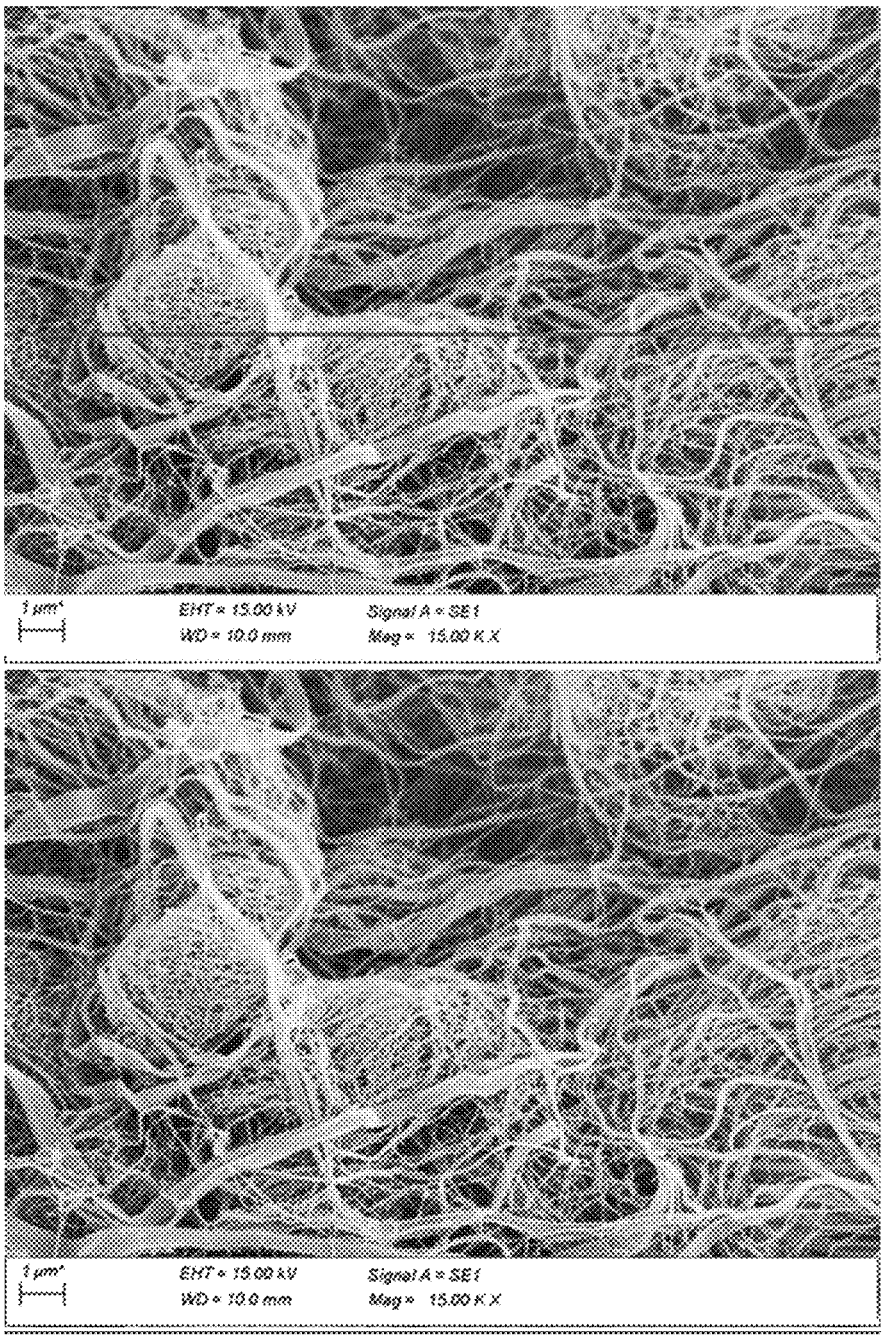
FIG. 5 is a scanning electron microscopy micrograph of a microfibrillated cellulose produced by the process of the present invention.
Figure 6:
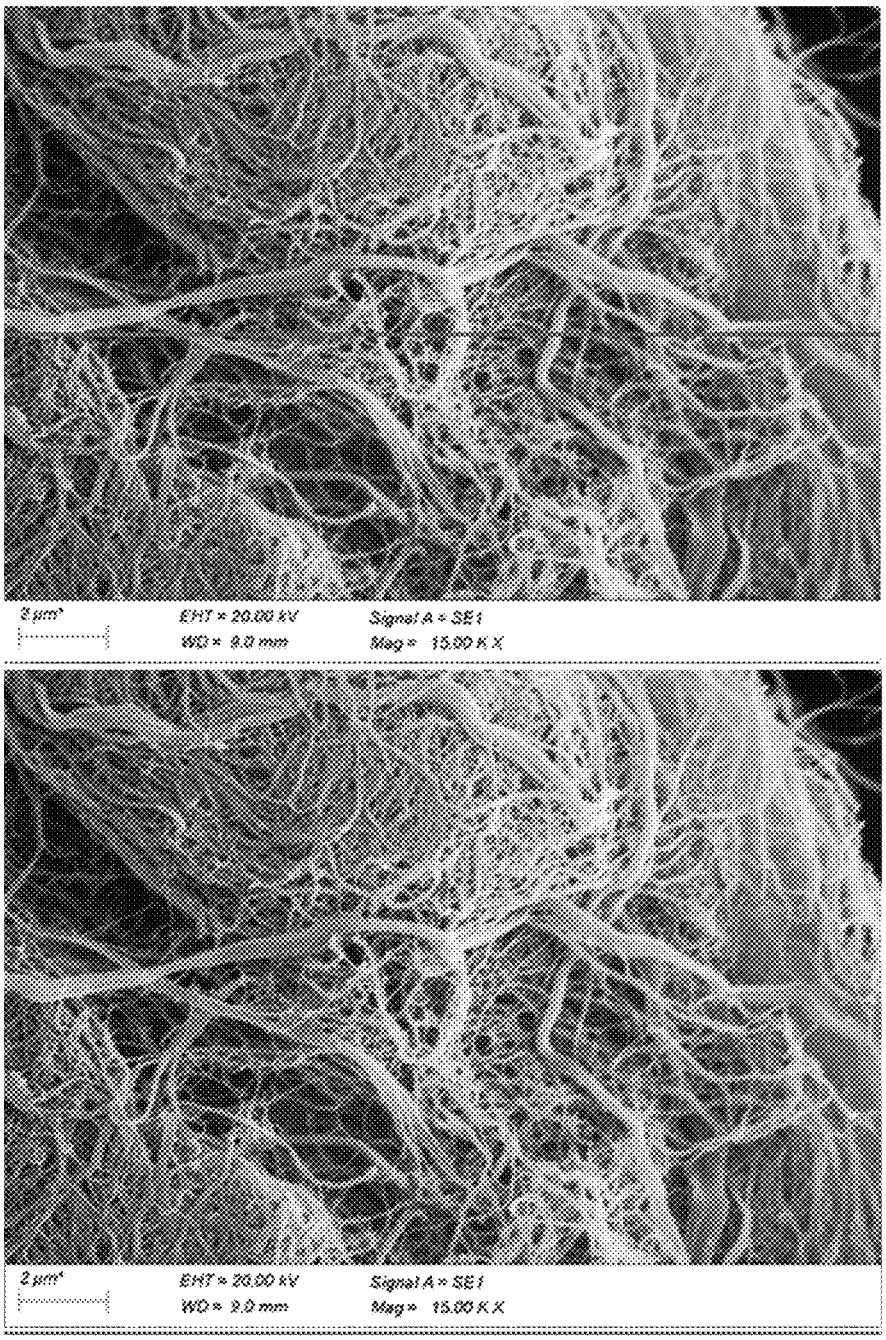
FIG. 6 is a scanning electron microscopy micrograph of a microfibrillated cellulose produced by the process of the present invention.
Figure 7:
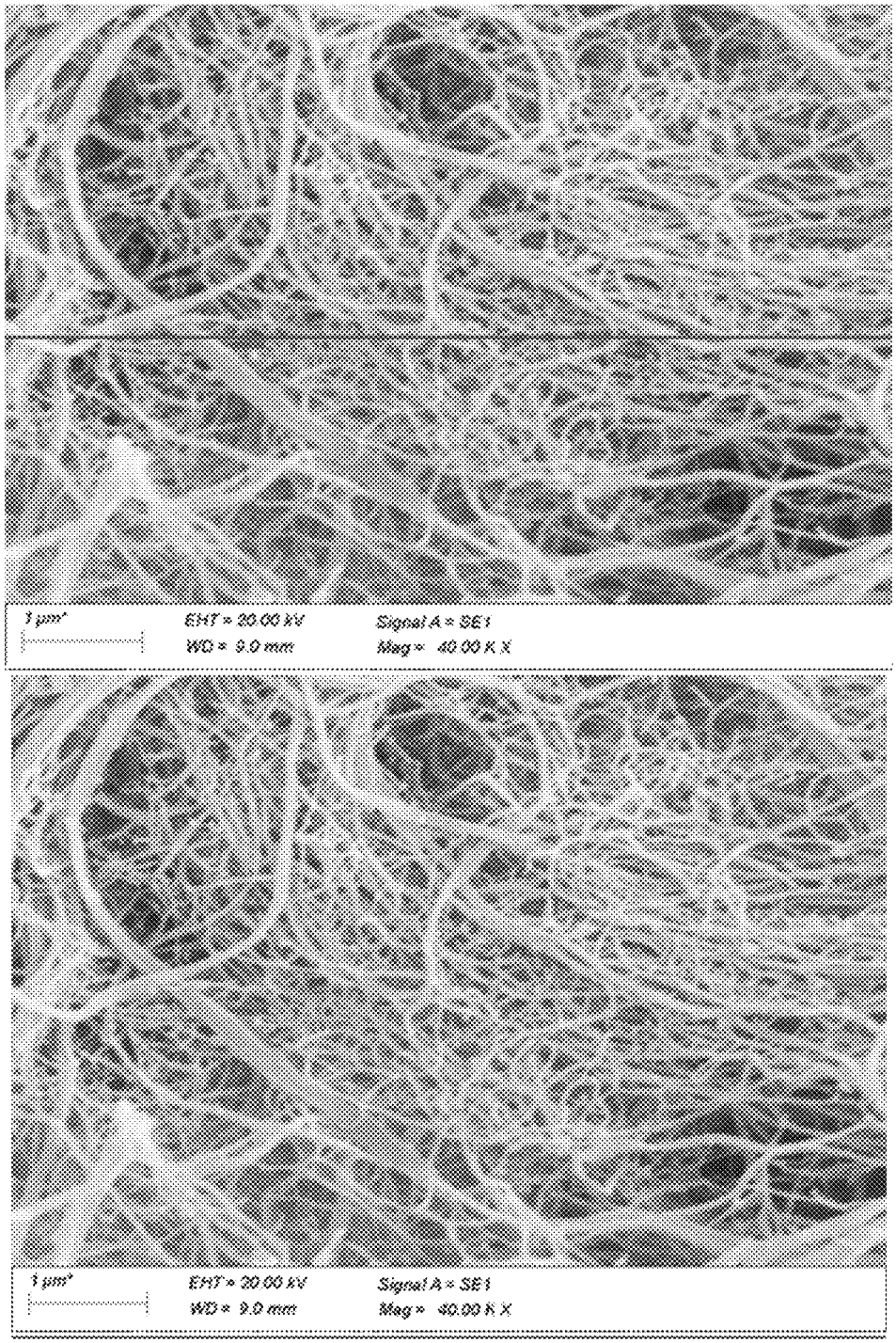
FIG. 7 is a scanning electron microscopy micrograph of a microfibrillated cellulose produced by the process of the present invention.
Figure 8:
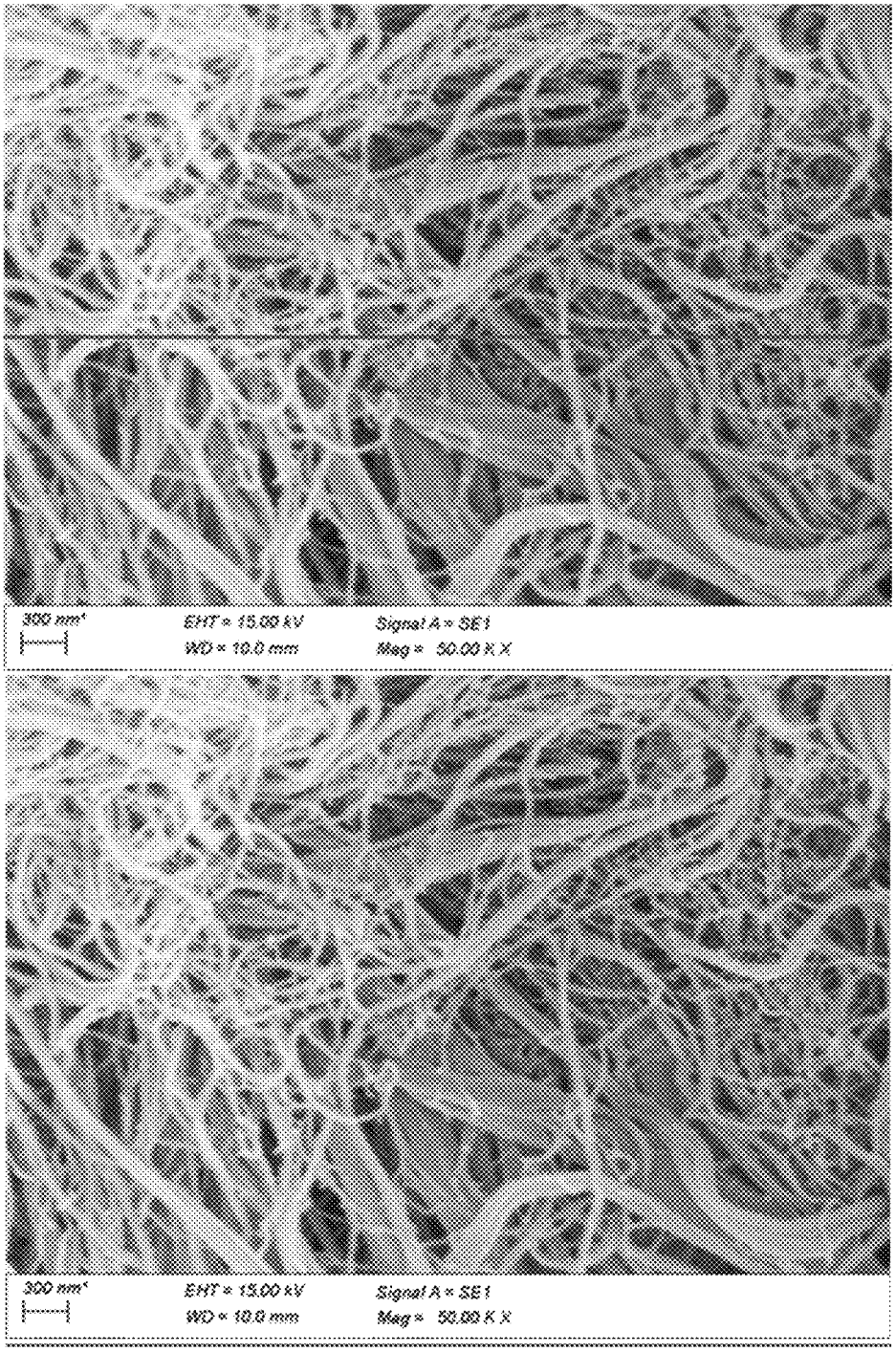
FIG. 8 is a scanning electron microscopy micrograph of a microfibrillated cellulose produced by the process of the present invention.

FIG. 3 exhibits a scanning electron microscopy micrograph of cellulose fibers before the treatment of the present invention and FIGS. 4-8 are different magnifications of a typical MFC obtained with the present process.

The fibers capable of producing the microfibrillated cellulose of the present invention are cellulose fibers, Kraft fibers, bleached cellulose fibers, semi-bleached cellulose fibers, unbleached cellulose fibers; dry cellulose fibers, never dry cellulose fibers or mixtures thereof.

The slurry of MFC or NFC, or their combinations, may be previously obtained by processing the cellulose fibers with disc refiners, conical refiners, or combinations thereof. In this sense, processing the fibers is prevalently refining the fiber in order to decrease its diameter, previously to subjecting the MFC or NFC to the process to produce a highly microfibrillated cellulose, object of the present invention.

In one embodiment, the present invention is achieved by a process to produce a highly microfibrillated cellulose, which process comprises the steps of providing a slurry comprising cellulose fibers such as Kraft fibers, bleached cellulose fibers, semi-bleached cellulose fibers, unbleached cellulose fibers; dry cellulose fibers, never dry cellulose fibers or mixtures thereof. The process of the present invention will produce microfibrillated cellulose fibers will produce highly microfibrillated cellulose by subjecting the slurry of Kraft fibers, bleached cellulose fibers, semi-bleached cellulose fibers, unbleached cellulose fibers; dry cellulose fibers, never dry cellulose fibers or mixtures thereof to defibrillation under continuous impacts. In such embodiment, the Kraft fibers, bleached cellulose fibers, semi-bleached cellulose fibers, unbleached cellulose fibers; dry cellulose fibers, never dry cellulose fibers or mixtures thereof will produce highly nanofibrillated cellulose by subjecting the slurry of Kraft fibers, bleached cellulose fibers, semi-bleached cellulose fibers, unbleached cellulose fibers; dry cellulose fibers, never dry cellulose fibers or mixtures thereof to defibrillation under continuous impacts.

Figure 9:
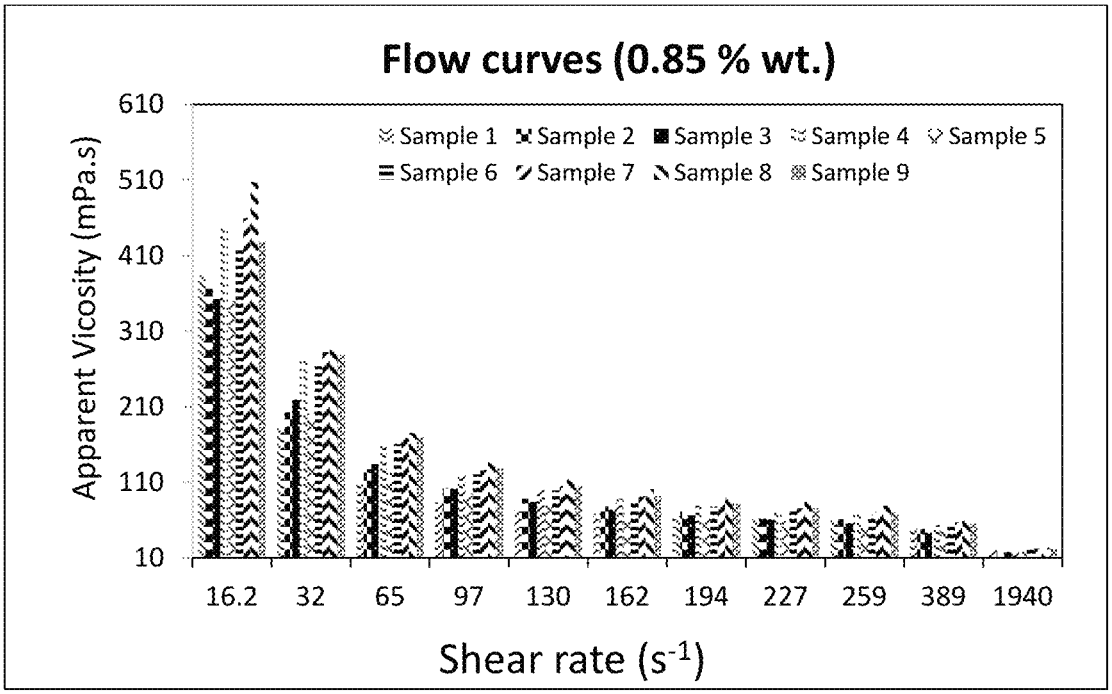
FIG. 9 is a flow curve of a slurry having 0.85% wt. of samples 1-9 of microfibrillated cellulose produced by the process of the present invention.

The rheological behavior of the MFC obtained shows that it has high dynamic viscosity at low shear stresses. When the shear rate is increased, the viscosity values decrease, showing the well-known shear thinning behavior of microfibrillated celluloses. FIG. 9 depicts typical flow curves (viscosity ratio versus shear rate) of the MFC at 0.85% mass concentration in water, obtained by the present process.

The invention claimed is:

1. A process to produce a highly microfibrillated cellulose, which process comprises the steps of:

a. providing a slurry comprising cellulose fibers, b. subjecting the slurry to defibrillation under continuous impacts provided by non-cutting bars to produce microfibrillated cellulose, wherein the highly microfibrillated cellulose is produced without the use of enzymatic or chemical treatments, wherein the slurry is subjected to continuous impacts from 5 to 240 minutes, and wherein the produced highly microfibrillated cellulose at 0.85% wt. in water comprises a dynamic viscosity from 15-1000 mPas·s.

2. The process according to claim 1 wherein the microfibrillated cellulose is returned as a slurry to step a) to another defibrillation step.

3. The process according to claim 1 wherein the impacts are provided by non-cutting bars in a rotor, in a stator or in both.

4. The process according to claim 1 wherein the non-cutting bars are projections in the rotor, the stator or in both.

5. The process according to claim 1 wherein a non-cutting bar alternate with a bar gap in the rotor, the stator or in both.

6. The process according to claim 1 wherein the bar gap between two non-cutting bars in the same ring is at least 1 mm.

7. The process according to claim 1 wherein the non-cutting bars have a bar gap in a ring disposition at the rotor, the stator or in both.

8. The process according to claim 1 wherein one of the rotor, the stator, or both, is rotating.

9. The process according to claim 1 wherein the bars are rotating at a linear speed of at least 20 m/s.

10. The process according to claim 1 wherein the non-cutting bars at the rotor and the non-cutting bars at the stator are disposed concentrically to produce a ring gap of at least 0.2 mm between the bars at the rotor and the bars at the stator.

11. The process according to claim 1 wherein the slurry is subjected to continuous impacts under controlled temperature from 50 to 70° C.

12. The process according to claim 1 wherein the fibers are cellulose fibers, Kraft fibers, bleached cellulose fibers, semi-bleached cellulose fibers, unbleached cellulose fibers; dry cellulose fibers, never dry cellulose fibers or mixtures thereof.

13. The process according to claim 1 wherein the slurry comprises a consistency from 2.0 to 6%.

14. The process according to claim 1 wherein at least one pH modifier is added to the slurry, so that modified microfibrillated cellulose is formed.

15. The process according to claim 1 wherein the pH modifier will produce a slurry having a pH from 4.0 to 9.0.

16. The process according to claim 1 wherein the fibers are microfibrillated cellulose, nanofibrillated cellulose, or mixtures thereof.

17. The process according to claim 16 wherein the fiber was processed with disc refiners, conical refiners, or combinations thereof.

18. The process according to claim 1, wherein the produced highly microfibrillated cellulose has a diameter from 0.01 μm to 0.8.

* * * * *